US008201410B2

(12) United States Patent
Imano et al.

(10) Patent No.: US 8,201,410 B2
(45) Date of Patent: Jun. 19, 2012

(54) HIGH-TEMPERATURE STEAM TURBINE POWER PLANT

(75) Inventors: Shinya Imano, Hitachi (JP); Eiji Saito, Hitachi (JP); Jun Iwasaki, Higashimurayama (JP); Masaki Kitamura, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 772 days.

(21) Appl. No.: 12/100,442

(22) Filed: Apr. 10, 2008

(65) Prior Publication Data

US 2008/0250790 A1 Oct. 16, 2008

(30) Foreign Application Priority Data

Apr. 13, 2007 (JP) ..... 2007-106019

(51) Int. Cl.
*F01K 7/32* (2006.01)
*F01K 1/00* (2006.01)

(52) U.S. Cl. ..... 60/647; 60/657; 60/670

(58) Field of Classification Search ..... 60/647, 60/657, 670

See application file for complete search history.

(56) References Cited

U.S. PATENT DOCUMENTS

| | | | | |
|---|---|---|---|---|
| 4,550,569 | A * | 11/1985 | Isa et al. | 60/657 |
| 6,546,713 | B1 * | 4/2003 | Hidaka et al. | 60/39.182 |
| 6,574,966 | B2 * | 6/2003 | Hidaka et al. | 60/806 |
| 2003/0061796 | A1 | 4/2003 | Kaijima | |

FOREIGN PATENT DOCUMENTS

| | | |
|---|---|---|
| CH | 523 420 A | 5/1972 |
| JP | 2001-082109 | 3/2001 |
| JP | 2003-106110 | 4/2003 |
| JP | 2005-002929 | 1/2005 |
| JP | 2005-060826 | 3/2005 |
| JP | 2006-153869 | 6/2006 |

OTHER PUBLICATIONS

E. Sato et al., Development of the Ultra-Supersritical Steam Turbine for Large Coal-fired Power Plants, Proc. Power-Gen International, (2004) pp. 1-12.

JP Office Action Application No. 2007-106019 dated Sep. 15, 2010 with translation.

EP Office Action of Application No. 08007147.5 dated Nov. 13, 2009 in English.

* cited by examiner

*Primary Examiner* — Hoang M Nguyen

(74) *Attorney, Agent, or Firm* — Antonelli, Terry, Stout & Kraus, LLP.

(57) ABSTRACT

A high-temperature steam turbine plant is of the top turbine type and structured as follows. It comprises a boiler building including a vertical boiler on the top of which a VHT turbine is installed; and a turbine building installed on the ground as a base. The VHT turbine and a generator connected with it are installed on the top of the boiler. The material for the portion of the steam pipe between the boiler building and the turbine building which is exposed to highest steam pressure is austenite steel which contains 50 weight % or more of ferrite steel or Fe. The inlet temperature of the VHT turbine is 675° C. or more and its outlet temperature is 550° C. or more and 650° C. or less.

4 Claims, 8 Drawing Sheets

HIGH-TEMPERATURE STEAM TURBINE POWER PLANT

CLAIM OF PRIORITY

The present application claims priority from Japanese application serial no. 2007-106019, filed on Apr. 13, 2007, the content of which is hereby incorporated by reference into this application.

FIELD OF THE INVENTION

The present invention relates to a high-temperature steam turbine power plant driven by a main steam temperature of 675° C. or more and having a power output of 100 MW or more.

BACKGROUND OF THE INVENTION

For improvement in the power generation efficiency of a steam turbine power plant, it is effective to increase the main steam temperature. Conventional steam turbine power plants with a main steam temperature of 600° C. or more are commercially in operation and the development of a steam turbine with a main steam temperature of 650° C. or so is underway. For a higher efficiency, efforts to develop a steam turbine with a main steam temperature of 700° C. or more have also been continued.

For a steam turbine to achieve a main steam temperature of 700° C. or more, a rotor of the turbine should be made of Ni-base super alloy instead of steel which has been so far used as the rotor material because the allowable temperature limit of steel is about 650° C. Ni-base super alloy has higher strength than steel but it is more expensive and it is difficult to make a large forging such as a rotor from it. Currently Ni-base super alloys suitable for the manufacture of large forging are being developed, evaluated and tested and some of these Ni-base super alloys are expected to be usable for the manufacture of 10-ton class forging. Nevertheless, the weight of rotors used in common large steam turbines is in the range of 30-40 tons. For this reason, a welded rotor which is manufactured by welding several forged members is being explored. Furthermore, a compact high-temperature turbine of the top turbine type which comprises only parts to be exposed to high temperatures has been conceived (for example, see E. Saito, et al., "Development of the Ultra-Supercritical Steam Turbine for Large Coal-fired Power Plants", Proc. Power-Gen International, (2004)).

For a steam turbine plant to realize a main steam temperature of 700° C. or more, it is essential to provide not only a technique of manufacturing high temperature resisting parts of the turbine and boiler from Ni-base super alloy but also a technique of reducing the use of Ni (more expensive than steel) and expensive Co and Mo contained in some Ni-base super alloys.

In the case of welded rotor type turbines, provided that all rotors of 30-40 tons are made of Ni-base super alloy, a large quantity of nickel will be required; therefore, members to be exposed to high temperatures (a total weight thereof is equivalent to about 10 tons) are made of super alloy and the other members to be used at low temperatures are made of a steel material such as 12Cr steel and these members are joined. Since the total weight of the members for use at high temperatures is at most 10 tons or so, the use of Ni is reduced.

In this case, however, it is difficult to ensure reliability for the following reason: as the assembly of members of different materials is used for a long time at high temperatures, the compositional difference between materials may cause diffusion of elements, resulting in deterioration of the joints. Another problem is as follows: ferrite steel is used as the steel material because of its high strength at high temperatures and Ni-base super alloy has a thermal expansion coefficient higher than ferrite steel and this difference in thermal expansion coefficient may cause cracking due to thermal stress in the joining process or fatigue fracture due to thermal stress in use. For this reason, a Ni-base super alloy with a low thermal expansion coefficient must be used.

Among Ni-base super alloys are Ni—Fe-base super alloys which contain much Fe but have a high strength. However, Ni—Fe-base super alloys are not suitable as materials for welded rotors because Fe increases the linear expansion coefficient. In order to make the linear expansion coefficient of Ni-base super alloy almost equal to that of ferrite steel, the use of Fe (though inexpensive) should be avoided and the percentage of Mo, which decreases the thermal expansion coefficient, should be increased.

Ni-base super alloy which contains much Mo is suitable as a material for welded rotors but is costly because it does not contain inexpensive Fe but contains much Mo, a material more expensive than Ni. In case of the top turbine type, reliability is high because of the absence of welded portions and Ni—Fe-base super alloy, less costly, can be used, but the need for an additional turbine leads to cost rise.

Next, the problem with the boiler which produces high-pressure steam for supply to the steam turbine will be described.

In a large-scale steam turbine plant, the height of the boiler is generally 70 m or more and its higher portions is heated to higher temperatures than its lower portions and the piping for high-temperature high-pressure steam to be supplied to the steam turbine extends from the top of the boiler to the turbine building on the ground with its total length of 100 m or more.

For a steam turbine plant with a main steam temperature of 675° C. or more, since the allowable temperature limit of steel is 650° C. or so, the piping for high-temperature high-pressure steam must be made of Ni-base super alloy. This steam piping has an outside diameter of approximately 600 mm, a wall thickness of approximately 100 mm and a total length of 100 m or more and thus its total weight is much larger than the weight of Ni-base super alloy used in the turbine.

For a main steam temperature of 700° C. or less, the boiler material may be a Ni—Fe-base super alloy which is advantageous in terms of cost and workability, such as HR6W; however, for a main steam temperature of more than 700° C., the material should be a solution-hardened Ni-base super alloy with a high strength such as IN617 and for a main steam temperature of 720° C. or more, it should be a precipitation-hardened Ni-base super alloy with a higher strength such as Nimonic 263. Since IN617 and Nimonic 263 are not only costly but also poor in workability, it is impossible to manufacture a long pipe with an outside diameter of 600 mm or so from these super alloys. Therefore, a plurality of pipes with a smaller outside diameter must be used to supply high-temperature high-pressure steam from the boiler building to the turbine building but the use of plural pipes means an increase in weight per flow area and an increase in the total piping weight, leading to further cost rise.

With this background, efforts to develop a horizontal boiler which replaces the vertical boiler have been made for the purpose of shortening the piping between the turbine building and boiler building. The problems with a horizontal boiler are deterioration in combustion efficiency and a substantial increase in required installation space.

An object of the present invention is to provide a high temperature steam turbine power plant which uses a vertical boiler with a high combustion efficiency to achieve a main steam temperature of 675° C. or more and a power output of 100 MW or more and ensures both reliability and cost reduction.

SUMMARY OF THE INVENTION

According to one aspect of the present invention, a high-temperature steam turbine plant with a main steam temperature of 675° C. or more and a power output of 100 MW or more is of the top turbine type and structured as follows.

It comprises a boiler building having a vertical boiler on the top of which a VHT (Very High Temperature) turbine is installed; and a turbine building installed on the ground as a base. Here, a generator connected with the VHT turbine is installed on the top of the boiler. The material for the portion of the steam pipe between the boiler building and the turbine building which is exposed to highest steam pressure is austenite steel which contains 50 weight % or more of ferrite steel or Fe. The inlet temperature of the VHT turbine is 675° C. or more and its outlet temperature is 550° C. or more and 650° C. or less.

According to another aspect of the invention, in a high-temperature steam turbine plant structured as mentioned above, the VHT turbine may have an inlet temperature between 690-720° C. and an outlet temperature between 600-620° C. and comprise a monolithic rotor of Ni-base super alloy without any welded joints in the steam flow path. The weight of the steam flow path of the rotor may be 10 tons or less According to a further aspect of the invention, in a high-temperature steam turbine plant structured as mentioned above where the main steam temperature is 700° C. or more, a steam flow path between the vertical boiler and the VHT turbine may comprise a plurality of pipes with an outside diameter of 300 mm or less and their material may be precipitation-hardened Ni-base super alloy.

Therefore, the present invention provides an efficient high-temperature steam turbine plant which ensures both cost reduction and reliability.

BRIEF DESCRIPTION OF THE DRAWINGS

The invention will be more particularly described with reference to the accompanying drawings, in which.

DETAILED DESCRIPTION OF THE PREFERRED EMBODIMENTS

Figure 1:
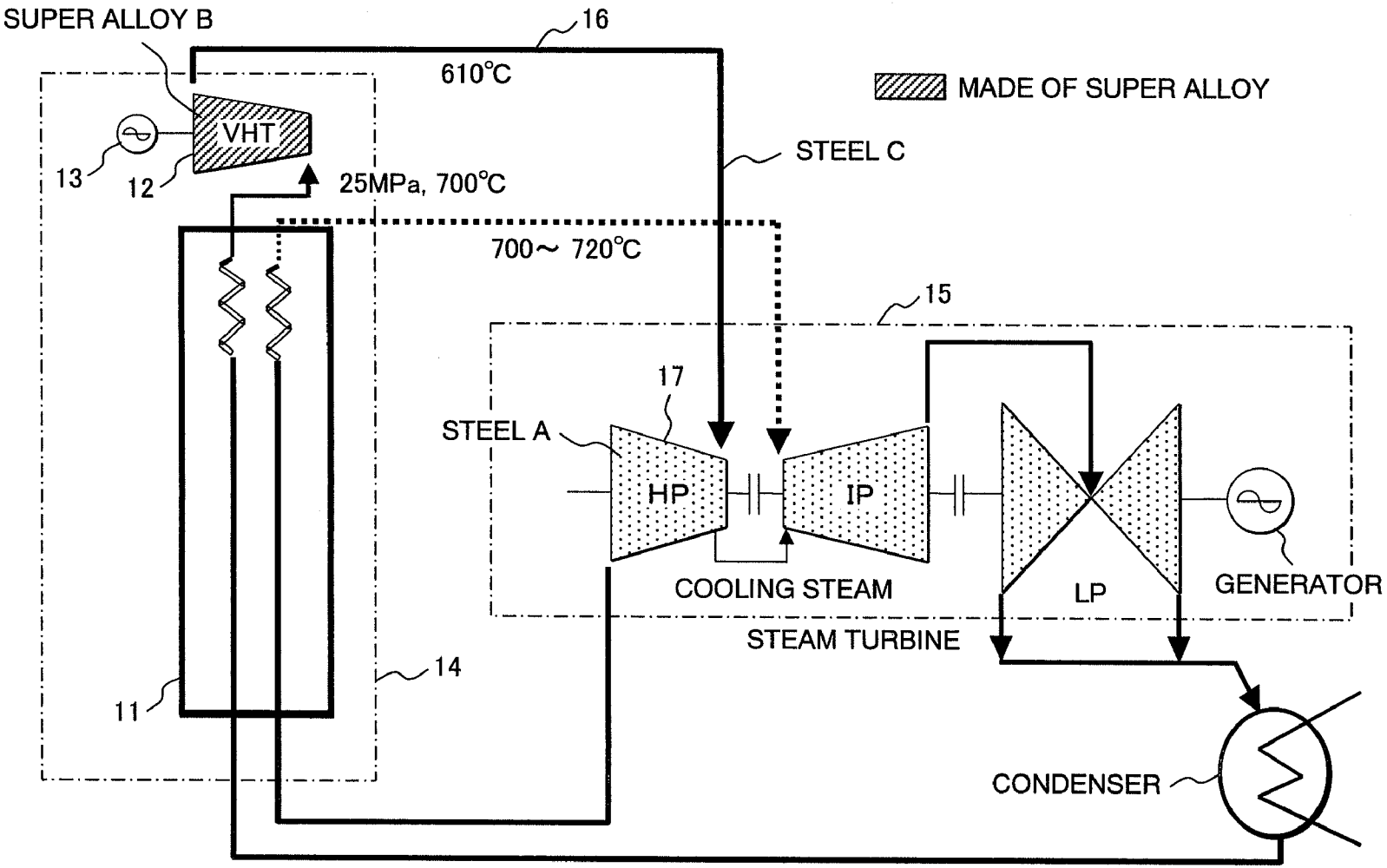
FIG. 1 schematically shows the configuration of a high-temperature steam turbine plant according to an embodiment of the present invention.

The VHT turbine means a top turbine. In order to use austenite steel with 50 weight % of ferrite steel or Fe as the material for the portion of the steam pipe between the boiler building and turbine building which is exposed to highest steam pressure, the outlet temperature of the VHT turbine must be 650° C. or less because the upper temperature limit of these materials is 650° C. When the portion of the steam pipe between the boiler building and turbine building which is exposed to highest steam pressure is made of steel instead of Ni-base super alloy, a material formerly used there, the use of nickel is remarkably reduced.

However, for ferrite steel whose upper temperature limit is more than 630° C., the melting and forging costs are high and in consideration of wake flow piping and turbine rotor costs, it is desirable that the outlet temperature of the VHT turbine be 630° C. or less.

To ensure high reliability, it is desirable to use a monolithic VHT turbine made of Ni-base super alloy. However, it is difficult to manufacture a forging with a weight of over 10 tons from Ni-base super alloy and in this case the VHT turbine has a size limit. When the VHT turbine outlet temperature is lower, the number of turbine stages should be larger, the rotor should be longer and the weight should be heavier. On the other hand, when the VHT turbine outlet temperature is higher, the rotor should be shorter and the weight should be lighter. Because of Ni-base super alloy's manufacturing limitations, it is desirable that in a monolithic VHT turbine made of Ni-base super alloy, the inlet temperature be in the range of 690-720° C. and the outlet temperature be not less than 600° C. and not more than 620° C.

For a rotor whose length is beyond Ni-base super alloy's manufacturing limitations, it is desirable to weld ferrite steel in order to make the outlet temperature not more than 620° C. However, while the monolithic turbine may be made of Ni—Fe base super alloy with low Ni content, the welded rotor requires the use of not only Ni but also expensive Ni-base super alloy with high Mo content (expensive), leading to cost rise. Another approach may be to join super alloy members by welding to get the required length but this approach would require a larger quantity of super alloy and thus use more Ni, leading to cost rise.

Provided that the steam temperature is 620° C. or less, it is desirable to feed steam through a ferrite steel pipe to a ferrite turbine in the boiler building. However, provided that the main steam temperature is far higher than 700° C., a forged rotor of 10 tons or so is used and the outlet temperature does not fall within the range of 630-650° C., then it is necessary to get the required rotor length by welding super alloy forged members to ensure that the outlet temperature falls within the range of 630-650° C. In other words, the present invention covers a high-temperature steam turbine plant which includes a VHT turbine with a rotor manufactured by welding super alloy members with a turbine inlet temperature of 720° C. and a turbine outlet temperature between 630-650° C. Since the turbine in the turbine building has a steam inlet temperature between 550-600° C. at the maximum pressure and is structurally similar to steam turbine plants currently in commercial operation which has a main steam temperature between 550-600° C. or so, it may be suitable to be used when a steam turbine plant with a main steam temperature between 550-

600° C. is to be replaced by one with a main steam temperature of 700° C. or so. The present invention also covers a steam turbine plant as a replacement as mentioned above.

Preferred Embodiments

Next, single reheat steam turbine plants with a power output of 500 MW or so and a main steam temperature of 700° C. according to preferred embodiments of the present invention will be explained along with comparative examples.

Table 1 shows the compositions (weight percent) of the materials used for the VHT turbine, HP turbine, and high pressure piping between the turbine building and boiler building in the steam turbine plant according to the present invention and their Ni equivalents. Since the present invention has an object to achieve both cost reduction and reliability, the use of expensive Ni should be minimized. Super alloys may contain expensive elements such as Mo, Co and W in addition to Ni and therefore Ni equivalents in Table 1 are considered as an index for super alloy material cost. Table 2 shows total nickel equivalents.

TABLE 1

Materials used for high-temperature steam turbine plants

| | Ni | Co | Mo | Cr | W | Other | Ni equivalent (Ni + 1.5 * Co + 2 * Mo+)/100 |
|---|---|---|---|---|---|---|---|
| Super alloy A | 55 | 11 | 8 | 22 | 3 | Al | 0.905 |
| Super alloy B | 40 | 0 | 0 | 16 | 0 | Nb, Al, Ti | 0.4 |
| Super alloy C | 50 | 20 | 6 | 20 | 0 | Al, Ti | 0.92 |
| Steel A | 0 | 0 | 0.15 | 11 | 2 | C | — |
| Steel B | 0.3 | 2.24 | 0.15 | 10.2 | 2.5 | B, C | — |
| Steel C | 0 | 0 | | 9 | 2 | V, N, Nb | — |

Remainder Fe

Figure 4:
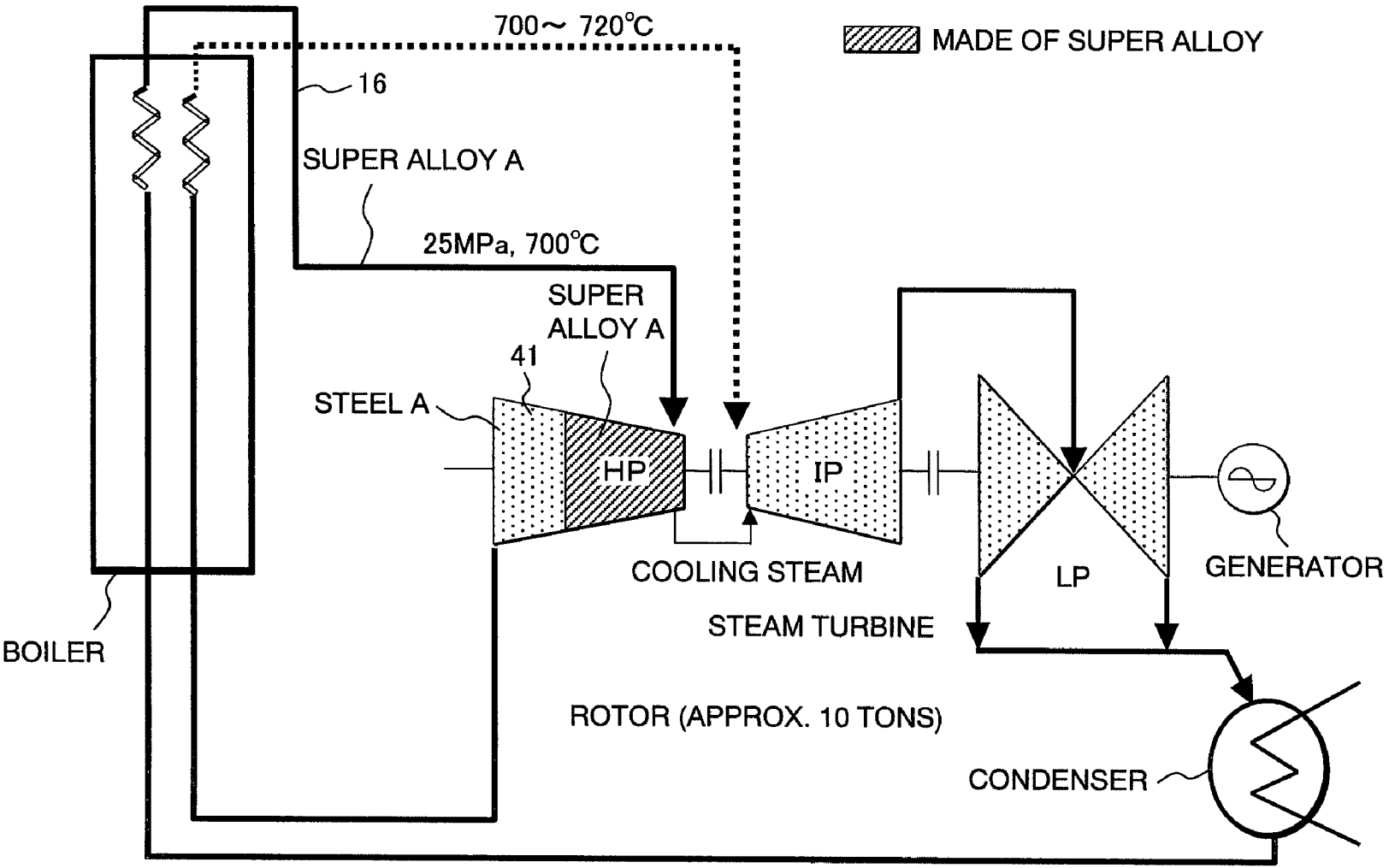
FIG. 4 schematically shows the configuration of a conventional high-temperature steam turbine plant.

FIG. 4 shows a conventional plant using a welded rotor for the HP turbine, which is hereinafter called Conventional Plant A. In this steam turbine plant, the super alloy used for the welded rotor 41 is super alloy A whose linear expansion coefficient is close to that of ferrite steel. For high pressure piping 16, super alloy A must be used in order to have both the required strength to withstand high temperature and high pressure and the required workability. In this case, the sum of Ni equivalents for the high pressure piping and the HP turbine is 54.6 tons.

Figure 5:
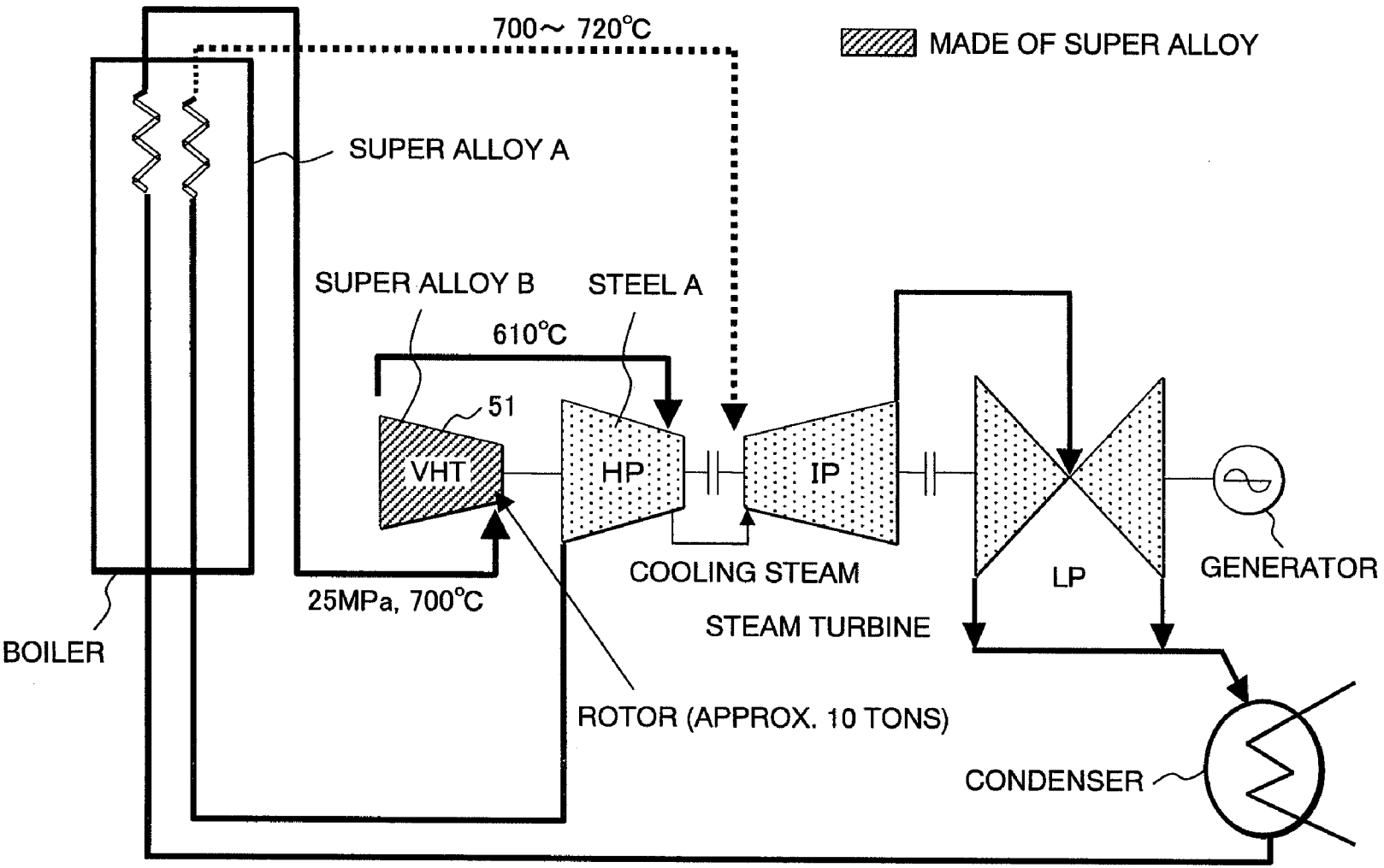
FIG. 5 schematically shows the configuration of another conventional high-temperature steam turbine plant.

FIG. 5 shows a conventional steam turbine plant of the top turbine type, which is hereinafter called Conventional Plant B. Since this plant uses no welded members, the material used for the VHT turbine 51 need not have a linear expansion coefficient similar to that of ferrite steel and may be super alloy B which contains much Fe and has excellent workability. In this plant, the total Ni equivalent is 49.5 tons, which is smaller than in Conventional Plant A. However, the use of one more turbine leads to cost rise.

FIG. 1 shows an embodiment of the present invention which will be hereinafter called Invention A1. The steam turbine plant as Invention A1 comprises: a boiler building 14 including a vertical boiler 11 on the top of which a VHT turbine 12 and an electric generator 13 are installed; and a turbine building 15 constructed on the ground. The VHT turbine 12 is installed on the top of the vertical boiler 11 and the generator 13 connected with the VHT turbine 12 is also installed there. Since the inlet temperature of the VHT turbine 12 is 650° C. or less, the material of the high pressure piping 16 between the turbine building 15 and boiler building 14 is ferrite steel instead of about 50 tons of super alloy which has been conventionally used.

In Invention A1, the outlet temperature is 610° C. and thus steel C may be used as the material of the high pressure piping 16 and steel A may be used as the material of the rotor of the HP turbine 17.

As the difference between the inlet temperature and outlet temperature of the VHT turbine 12 is larger, the required VHT

TABLE 2

Total Nickel Equivalents for VHT Turbines, High Pressure Piping and HP Portions

| | VHT | | | | | Turbine/boiler building | | | | | | |
|---|---|---|---|---|---|---|---|---|---|---|---|---|
| | | | | | | high pressure piping | | | HP portion super alloy | | | |
| | Inlet temp. | Outlet temp. | Material | Super-alloy weight (tons) | Ni equivalent (tons) | Material | Super-alloy (tons) | Ni equivalent (tons) | Material | Super-alloy (tons) | Ni equivalent | Total Ni equivalent |
| Conventional Plant A | 700 (HP) | 700 (HP) | — | — | 0 | Super-alloy A | 50 | 45.5 | Super-alloy A Steel A | 10 | 9.1 | 54.6 |
| Conventional Plant B | 700 | 610 | Super-alloy B | 10 | 4 | Super-alloy A | 50 | 45.5 | Steel A | 0 | 0 | 49.5 |
| Invention A1 | 700 | 610 | Super-alloy B | 10 | 4 | Steel C | 0 | 0 | Steel A | 0 | 0 | 4 |
| Invention A2 | 700 | 635 | Super-alloy B | 7 | 2.8 | Steel B | 0 | 0 | Steel B | 0 | 0 | 2.8 |
| Invention B | 730 | 620 | Superalloy A Superalloy C | 10 5 | 9.1 4.7 | Steel C | 0 | 0 | Steel A | 0 | 0 | 13.8 |
| Comparative Example 1 | 700 | 670 | Super-alloy B | 5 | 2 | Super-alloy A | 50 | 45.5 | Super-alloy A Steel A | 5 | 4.55 | 52.05 |
| Comparative Example 2 | 700 | 500 | Superalloy A Steel A | 10 | 9.1 | Steel C | 0 | 0 | Steel A | 0 | 0 | 9.1 |
| Comparative Example 3 | 700 | 300 | Superalloy A Steel A | 10 | 9.1 | — | — | — | — | — | — | 9.1 |

turbine length is longer and the rotor is heavier. Thus the rotor weight may exceed 10 tons of the manufacturing limit for super alloy A and super alloy B, and it may be impossible to manufacture a monolithic rotor. In Invention A1, the weight of the VHT turbine rotor is very close to the manufacturing limit for super alloy B (10 tons) but does not exceed it and the rotor is monolithic. In this plant, the total Ni equivalent is 4 tons, which is drastically smaller than in Conventional Plants A and B. In comparison with Conventional Plant A, the total Ni equivalent is reduced by more than 50 tons, which far outweighs the cost of addition of one small turbine and one small generator. Consequently, Invention A is less costly than Conventional Plant A and the absence of welded parts in the rotor ensures higher reliability.

Figure 2:
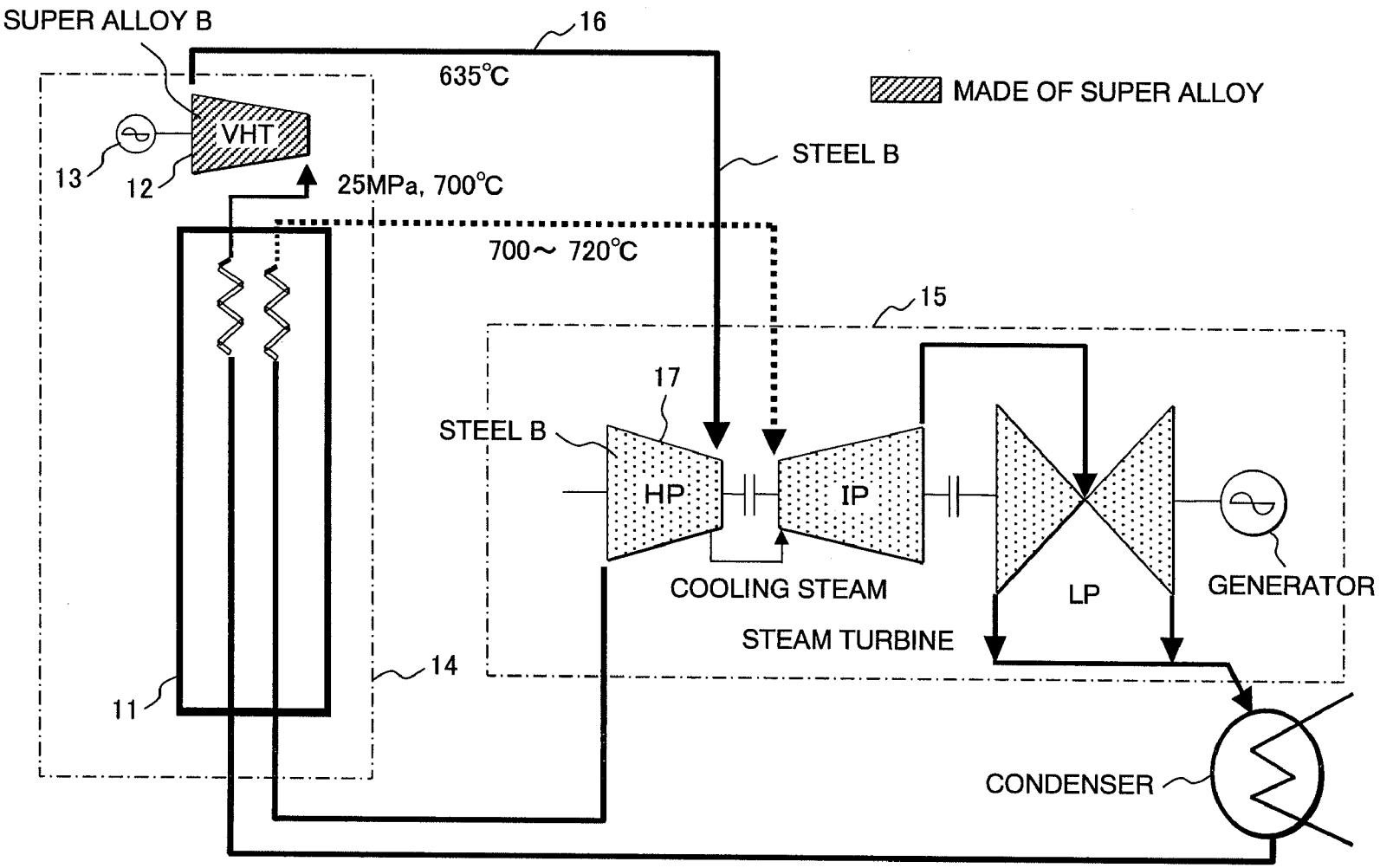
FIG. 2 schematically shows the configuration of a high-temperature steam turbine plant according to another embodiment of the present invention.

FIG. 2 shows an embodiment of the invention where the outlet temperature of the VHT turbine 12 is higher than in Invention A1 and this embodiment will be hereinafter called Invention A2. Although ferrite steel is considered to withstand up to 650° C., Co and B must be added to it for use at over 620° C. This means material cost rise and manufacturing cost rise. Steel B has a strong tendency to deteriorate in terms of strength when used for many hours. When comparison is made between the reliability of steel A at 620° C. or so and that of steel B at over 630° C., the reliability of steel A is higher than that of steel B.

In Invention A2, since the outlet temperature of the VHT turbine exceeds 620° C., steel B, which contains Co and B, is used for the high pressure piping 16 and the rotor of the HP turbine 17. In Invention A2, super alloy B is used for the VHT turbine 12. Since the outlet temperature in Invention A2 is higher than in Invention A1, the total rotor length is shorter and the rotor weight is lighter; thus the use of super alloy in Invention A2 is reduced and the total Ni equivalent in Invention A2 is lower than in Invention A1.

However, steel B, which is relatively expensive ferrite steel and lower in long-use reliability than steel B, must be used for the heavy high-pressure piping and HP turbine. Therefore, Invention A1 is better in terms of cost and reliability than Invention A2.

Figure 3:
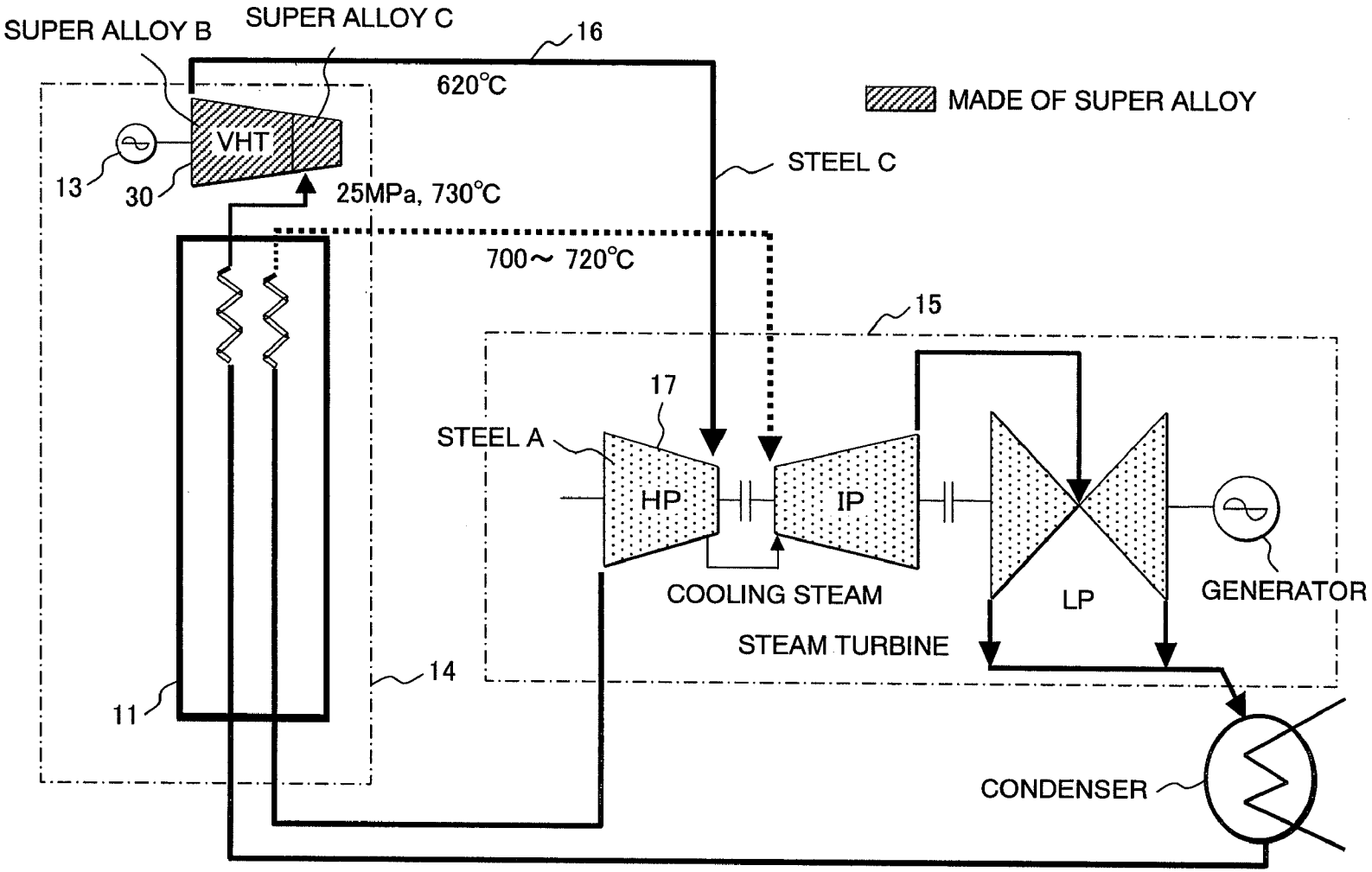
FIG. 3 schematically shows the configuration of a high-temperature steam turbine plant according to a further embodiment of the present invention.

FIG. 3 shows an embodiment of the invention where the inlet temperature of the VHT turbine is as high as 730° C., which will be hereinafter called Invention B. In order to use steel A and steel C, materials which meet both cost and reliability requirements, for the high pressure piping 16 and HP turbine 17, the outlet temperature of the VHT turbine must be 630° C. or less. In this case, the VHT turbine should have a longer total length and cannot be a monolithic structure of super alloy B. Furthermore, since super alloy B is insufficient in strength at 730° C., the portion to be exposed to high temperatures is made of super alloy C and welded to make the VHT turbine 30 with a welded rotor. In this case, the total Ni equivalent is approximately 14 tons, drastically lower than in Conventional Plants A and B in which the VHT turbine inlet temperature is 700° C.

In Invention B, Ni equivalent is slightly higher than in Invention A1 and Invention A2 but considering that the VHT turbine inlet temperature is 30° C. higher and the efficiency is thus improved, it may be said that Invention B is also effective enough.

Figure 6:
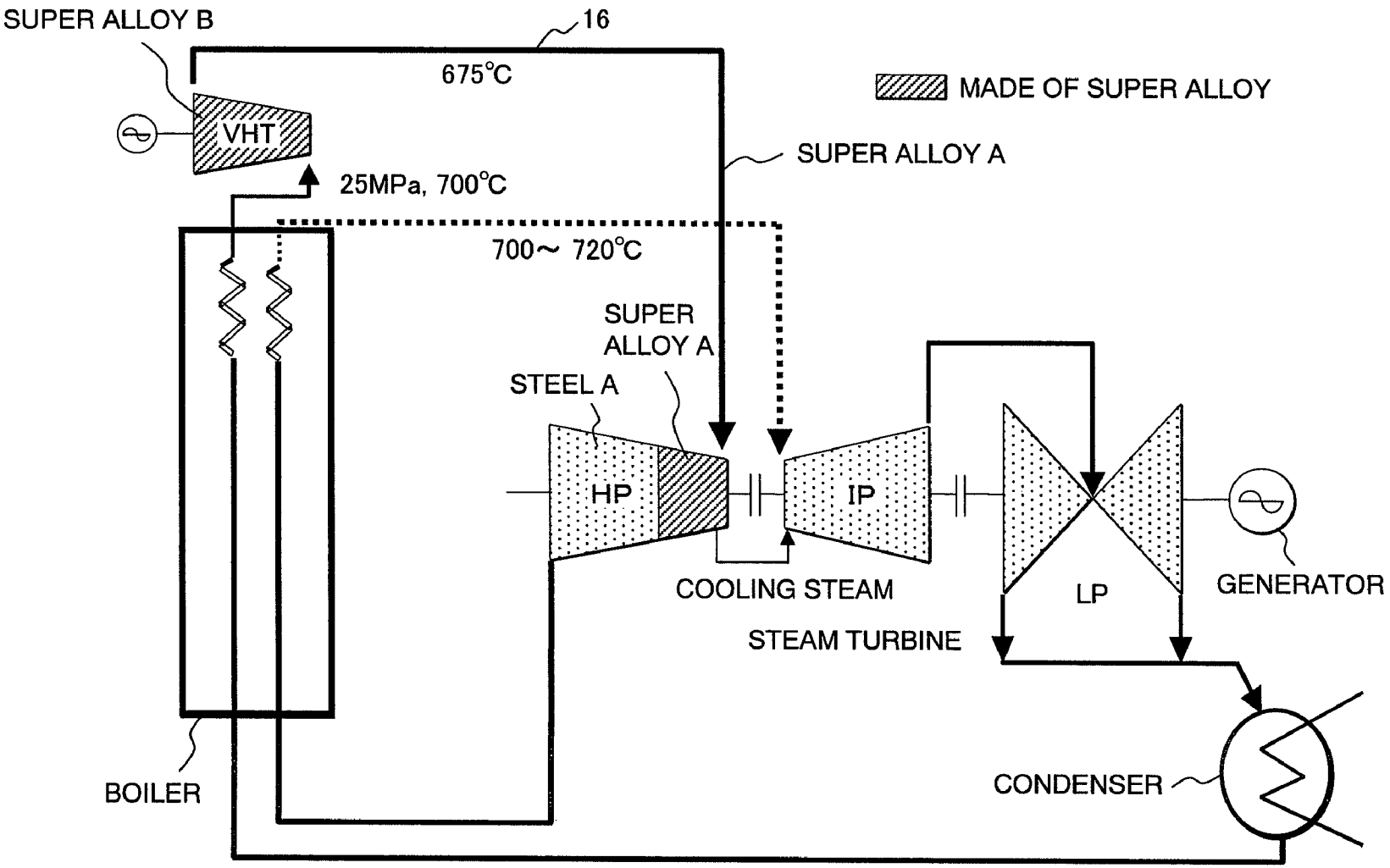
FIG. 6 schematically shows the configuration of a high-temperature steam turbine plant as a comparative example.

FIG. 6 shows comparative example 1 where the VHT turbine outlet temperature is 675° C. In this case, since the high-pressure piping 16 should be made of super alloy and the HP turbine should be a welded structure of super alloy and ferrite steel, the total Ni equivalent is not so different from that in Conventional Plants A and B. When the cost of an additional small generator is considered, comparative example 1 is not effective.

Figure 7:
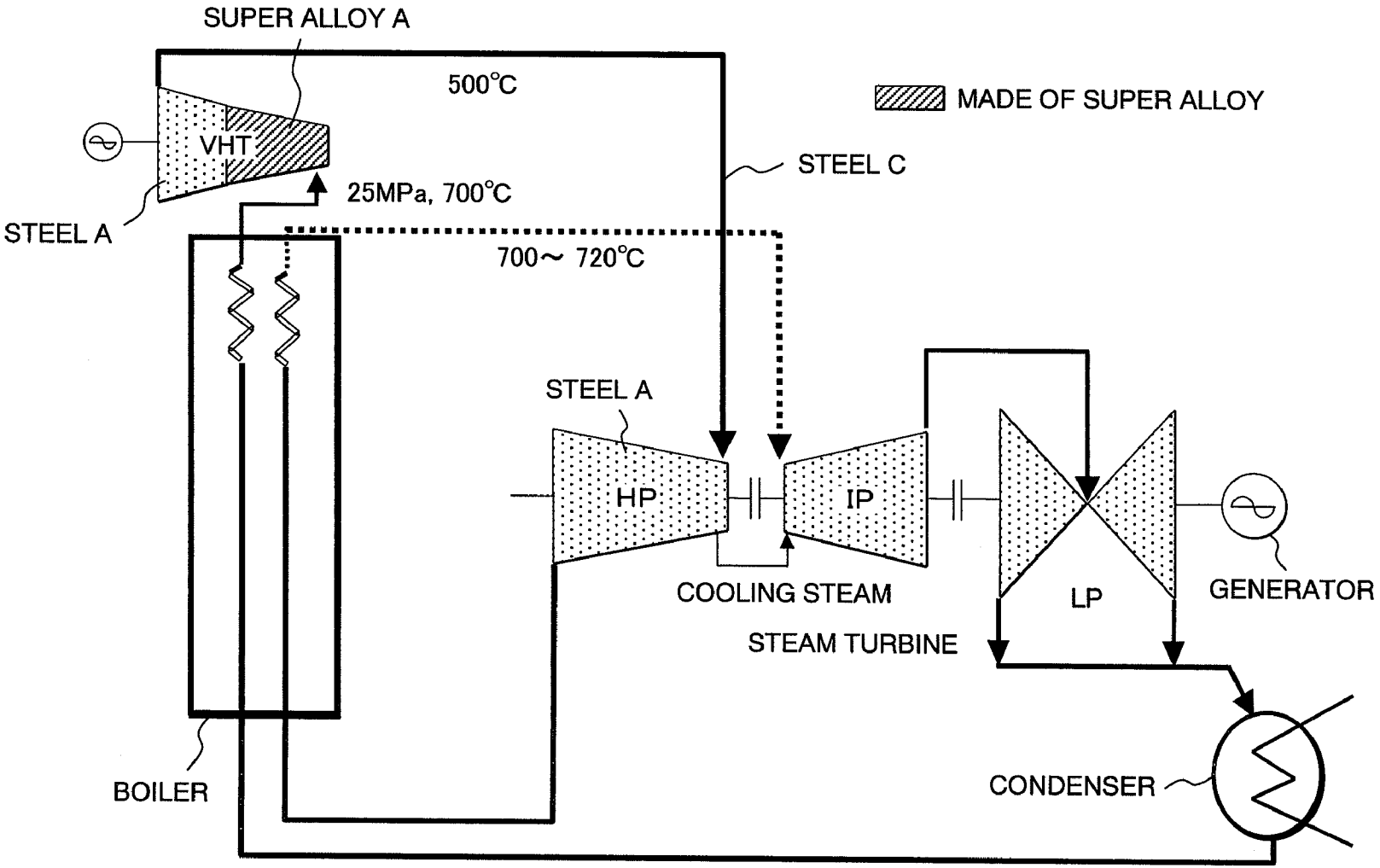
FIG. 7 schematically shows the configuration of a high-temperature steam turbine plant as another comparative example.

FIG. 7 shows comparative example 2 where the VHT turbine outlet temperature is as low as 500° C. In this case, the VHT turbine rotor should be a large welded rotor of super alloy A and steel A (ferrite steel). Since the total Ni equivalent is higher than in Invention A1 and Invention A2, this structure offers no advantage. In addition, since the total weight of the VHT turbine increases, an additional cost (reinforcement, etc) may be required for the turbine to be installed on the top of the boiler. Therefore, the VHT turbine outlet temperature must be 550° C. or more.

Figure 8:
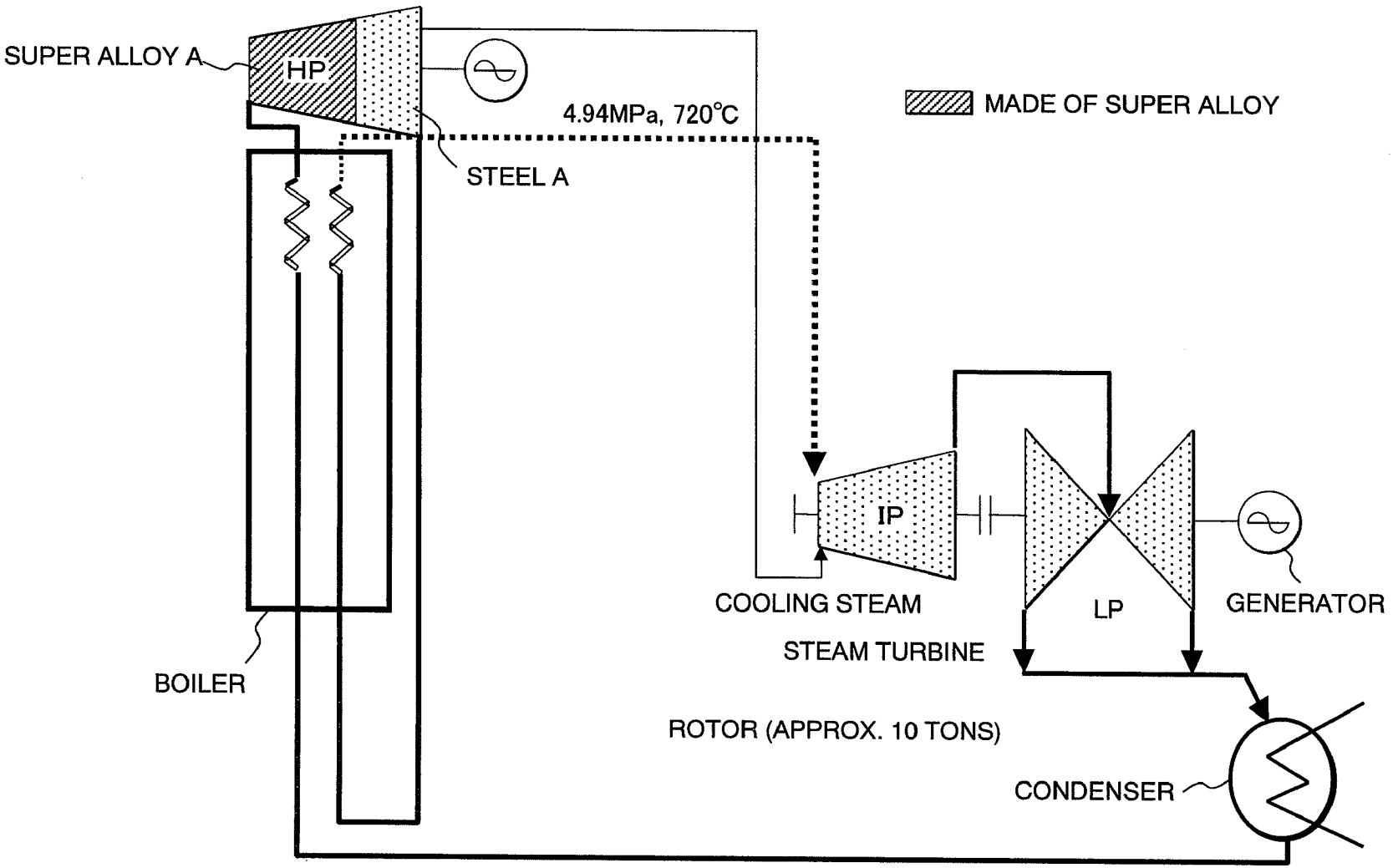
FIG. 8 schematically shows the configuration of a high-temperature steam turbine plant as a further comparative example.

FIG. 8 shows comparative example 3 where an HP turbine is all installed on the top of the boiler. However, since the HP turbine is a heavy structure of more than 150 tons, it is impossible and unrealistic to install it on the top of the boiler.

As explained so far, the present invention provides a high-temperature steam turbine plant which is advantageous over the conventional plants and other plants.

What is claimed is:

1. A high-temperature steam turbine plant with a main steam temperature of 675° C. or more and a power output of 100 MW or more comprising:

a boiler building including a vertical boiler on the top of which a VHT turbine is installed; and a turbine building installed on the ground as a base; wherein an inlet temperature of the VHT turbine is 675° C. or more and its outlet temperature is 550° C. or more and 650° C. or less;

the VHT turbine and a generator connected with the VHT turbine are installed on the vertical boiler; and a material for steam pipe portion between the boiler building and the turbine building which is exposed to highest steam pressure is austenite steel which contains 50 weight % or more of ferrite steel or Fe.

2. The high-temperature steam turbine plant according to claim 1, wherein the VHT turbine comprises a monolithic rotor of Ni-base super alloy without any welded joints in a steam flow path and its inlet temperature is between 690-720° C. and its outlet temperature is between 600-620° C.

3. The high-temperature seam turbine plant according to claim 2, wherein weight of a steam flow path of the rotor of Ni-base super alloy is 10 tons or less.

4. The high-temperature seam turbine plant according to claim 1, wherein a steam flow path between the vertical boiler and the VHT turbine comprises a plurality of pipes with an outside diameter of 300 mm or less, their material is precipitation-hardened Ni-base super alloy and main steam temperature is 700° C. or more.

* * * * *